US008511807B2

(12) United States Patent
Burress et al.

(10) Patent No.: US 8,511,807 B2
(45) Date of Patent: Aug. 20, 2013

(54) IMAGE TRANSFIX APPARATUS USING HIGH FREQUENCY MOTION GENERATORS

(75) Inventors: Edward F. Burress, West Linn, OR (US); Brent Rodney Jones, Sherwood, OR (US); Joseph B. Gault, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 274 days.

(21) Appl. No.: 12/944,038

(22) Filed: Nov. 11, 2010

(65) Prior Publication Data

US 2012/0120171 A1 May 17, 2012

(51) Int. Cl.

| | |
|---|---|
| ***B41J 2/175*** | (2006.01) |
| ***B41J 2/01*** | (2006.01) |
| ***B41J 29/38*** | (2006.01) |

(52) U.S. Cl.

USPC ..... 347/88; 347/99; 347/104; 347/16; 347/103

(58) Field of Classification Search

None

See application file for complete search history.

(56) References Cited

U.S. PATENT DOCUMENTS

| | | | | |
|---|---|---|---|---|
| 4,987,456 | A | 1/1991 | Snelling et al. | |
| 4,997,177 | A * | 3/1991 | Mori et al. | 271/267 |
| 5,071,113 | A * | 12/1991 | Nakamura et al. | 271/267 |
| 5,085,423 | A * | 2/1992 | Nishimoto et al. | 271/266 |
| 5,149,080 | A * | 9/1992 | Yamamoto | 271/265.01 |
| 5,249,795 | A * | 10/1993 | Nishimoto | 271/265.02 |
| 5,329,341 | A | 7/1994 | Nowak et al. | |
| 5,357,324 | A | 10/1994 | Montfort | |
| 6,068,256 | A * | 5/2000 | Slutskiy et al. | 271/264 |
| 6,561,509 | B2 * | 5/2003 | Kettenmann et al. | 271/263 |
| 6,585,253 | B1 * | 7/2003 | Miki | 271/125 |
| 6,712,357 | B1 * | 3/2004 | Tranquilla | 271/273 |
| 7,322,689 | B2 * | 1/2008 | Kohne et al. | 347/103 |
| 7,931,362 | B2 * | 4/2011 | Burke | 347/103 |
| 2006/0290760 | A1 * | 12/2006 | German et al. | 347/102 |
| 2007/0120930 | A1 * | 5/2007 | Domoto et al. | 347/102 |
| 2010/0141720 | A1 * | 6/2010 | Ready et al. | 347/88 |

* cited by examiner

*Primary Examiner* — Stephen Meier
*Assistant Examiner* — Leonard S Liang
(74) *Attorney, Agent, or Firm* — Maginot, Moore & Beck, LLP

(57) ABSTRACT

A phase change ink imaging device includes a transfix apparatus configured to apply ultrasonic action to ink pixels deposited onto an image bearing surface to facilitate transfer and/or fixing of the ink pixels to print media.

18 Claims, 5 Drawing Sheets

IMAGE TRANSFIX APPARATUS USING HIGH FREQUENCY MOTION GENERATORS

TECHNICAL FIELD

This disclosure relates generally to phase change ink printers, and in particular to transfix apparatus used in phase change ink printers.

BACKGROUND

Phase change ink imaging apparatus utilize phase change ink to form images on recording media. These apparatus typically include inkjets configured to eject drops of melted phase change ink using either a direct or an offset printing process. In a direct printing process, the ink is deposited directly onto print media. In an offset printing process, the ink is first deposited onto an imaging drum and then transfixed to print media by a transfix roller. In most previously known devices, the transfix roller is loaded against the surface of the imaging drum to form a nip. Sheets of print media are fed through the nip in synchronization with the ink deposited onto the surface of the drum. A predetermined pressure generated by the rolling contact between the print media and the imaging drum in the nip causes the molten ink to transfer and become fixed (i.e., transfixed) to the print media.

The temperature of the print media is typically required to be elevated to a certain degree upon entering the nip to facilitate the transfix process and promote consistent image quality. The elevated temperature of the media also reduces the pressure requirement for the nip. Most previously known phase change ink imaging devices utilize some form of media preheater to elevate the temperature of the media to a desired degree before the media is fed through the nip. While effective, heaters consume energy and affect the cost of operating a printer. Improving energy efficiency in printer technology is a worthwhile goal, and becomes very significant in view of energy conservation efforts and regulatory requirements.

SUMMARY

In accordance with one embodiment of the present disclosure, a phase change ink imaging device includes a media transport configured to transport media along a path and a moving member movable proximate at least a portion of the path. The moving member has an image bearing surface. The imaging device includes at least one printhead configured to form an ink image on the image bearing surface, and an image transfix apparatus having at least one transducer configured to direct mechanical energy toward the path after the ink image has been formed on the image bearing surface.

In another embodiment, a phase change ink imaging apparatus includes a media transport configured to transport media along a path, an image bearing surface configured to move proximate a portion of the path, and at least one printhead is configured to form an ink image on the image bearing surface. At least one motion generator is positioned proximate the portion of the path. The at least one motion generator and the image bearing surface define an image transfer zone through which the portion of the path extends. The at least one motion generator includes piezoelectric transducers configured to impact print media moving along the portion of the path at one or more predetermined frequencies.

DETAILED DESCRIPTION

Figure 1:
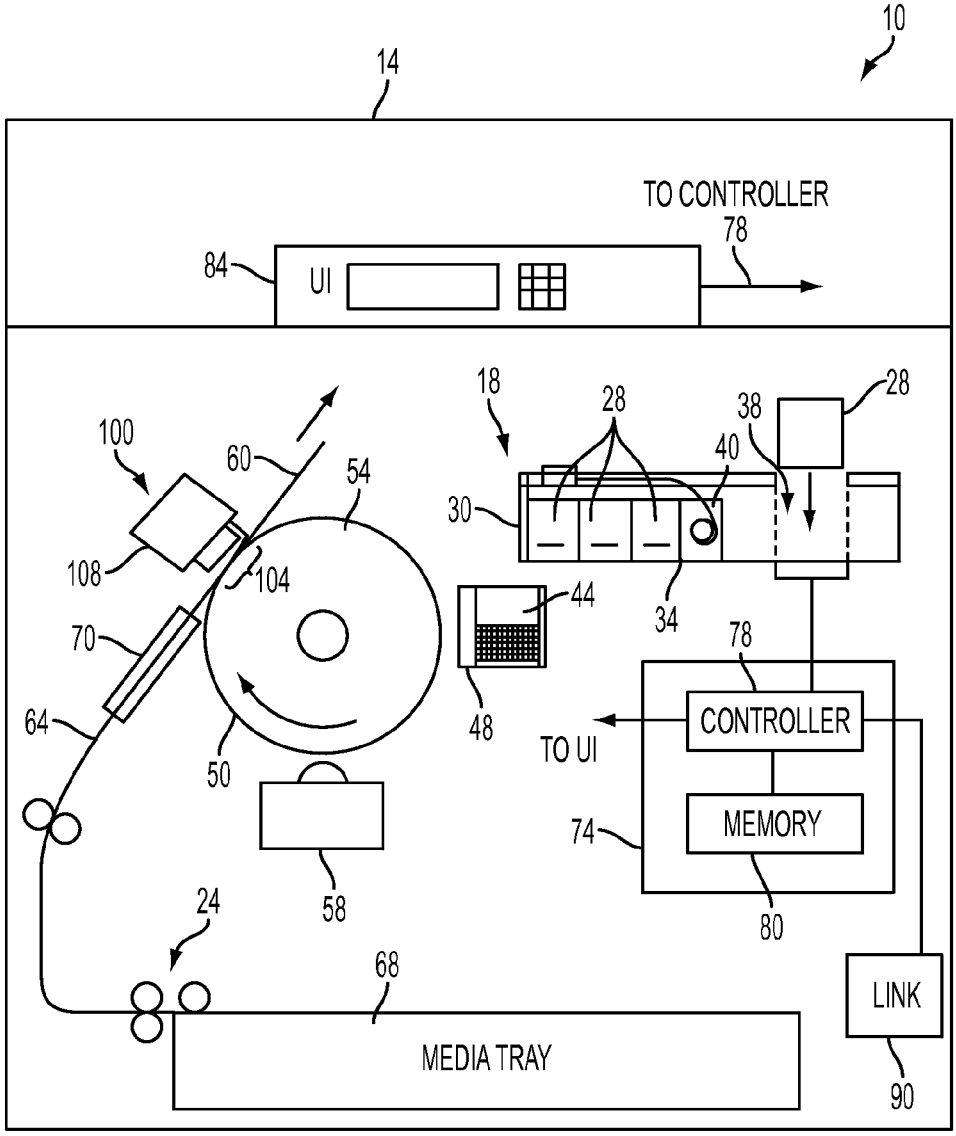
FIG. 1 is simplified elevational view of an embodiment of a phase change ink imaging device including a high-frequency transfix apparatus according to the present disclosure.

For a general understanding of the present embodiments, reference is made to the drawings. In the drawings, like reference numerals have been used throughout to designate like elements. As used in this document, the word "printer" refers to any device that generates images on media and includes, but is not necessarily limited to inkjet printers, copiers, facsimile machines, multi-function machines, and the like.

The present disclosure is directed to an image transfix apparatus for use in a phase change inkjet printer having an image bearing surface that moves within the imaging device. The image transfix apparatus is positioned proximate the moving surface and includes at least one motion generator that is spaced apart from the moving image bearing surface to define a gap. As explained below, the motion generator may have at least one ultrasonic transducer that is configured to extend into the gap and then retract to contact or impact the image bearing surface rapidly as the image on the surface moves past the transducer in order to spread the ink on the image bearing surface and to transfer and affix the ink to the print media passing through the gap.

The ultrasonic transducers of the motion generator are configured to extend and retract at one or more predetermined frequencies in or near the ultrasonic frequency range. The ultrasonic motion facilitates a near frictionless passage of the image bearing surface through the gap to negate the need for rolling contact as used in previously known transfix apparatus. In addition, the energy generated by the ultrasonic motion elevates the temperature of both the ink and the image bearing surface. The temperature elevation occurs almost instantly, which may reduce or eliminate the need to preheat the image bearing surface and/or print media. Reducing or eliminating preheating requirements shortens the media warm-up time and allows the printer to be shutdown more frequently. Shutting down the printer reduces the energy expenditure of the printer and lowers the associated costs of operating the printer. In addition, the elevated temperatures reduce the force required to achieve a given amount of ink spread resulting in a further reduction in energy expenditure.

The transfix apparatus, as described herein, may be utilized in both offset and direct printing systems. In an offset printing system, the image bearing surface may be a surface of a rotating member, such as a drum, platen, band, or belt, as depicted in FIG. 1. In this case, melted phase change ink drops are deposited onto the surface of the rotating member. As the ink drops on the surface are moving through the gap, sheets of print media are moved along a path through the gap in synchronization with the drops. The media path is interposed between the motion generator and the ink image on the surface of the rotating member so the ultrasonic transducers impact the print media overlying the ink drops. The rapid impacts spread the ink drops on the surface of the rotating member and press the ink against the print media to facilitate the transfer and affixing of the ink to the media.

In systems that utilize an imaging member in the form of a band or belt, an additional motion generator may be positioned to direct ultrasonic action to the inner surface of the belt or band opposite from a first motion generator unit. In this case, the ultrasonic action of the additional motion generator in conjunction with the action of the first motion generator serves to stiffen the belt or band to provide a backing surface to facilitate ink spread and transfix the ink to the print media.

The image bearing surface may also comprise print media. For example, in a direct printing system, ink is deposited directly onto print media. In this case, a transfix apparatus may be utilized to apply ultrasonic action to spread the ink and fix the ink to the media. Motion generators may be positioned on one or both sides of the print media to apply mechanical energy to one or both sides of the print media. A similar setup may be utilized in offset systems in which ink is first deposited onto an imaging member and then transferred to print media from the imaging member where the ink is not fixed to the media during the transfer process.

Imaging applications include printing on various media ranging in porosity and smoothness as well as other properties. For example, news print, paper, transparencies, card stock, packaging material, and the like may be printed using the printing system described in this document. Various ink materials, image receiving media, and imaging applications emphasizing one or more objectives, such as image quality, cost, speed or energy efficiency, would enable or favor one or more specific implementations of motion generator transfix apparatus to facilitate image transfer/transfix.

Referring now to FIG. 1, a simplified elevational view of a phase change inkjet printer is depicted in which one embodiment of a high-frequency image transfix apparatus 100 is incorporated. As depicted, the printer 10 has a housing 14 that supports and at least partially encloses the various apparatus and components of the printer 10, including an ink loader 18, at least one printhead 48, media supply and handling apparatus 24, and the image transfix apparatus 100. Any suitable housing 14 may be used depending on the configuration of the device 10, and, in particular, the arrangement, dimensions, and operational requirements of the apparatus and components in the printer.

The ink loader 18 is configured to receive phase change ink in its solid form as blocks of ink 28, referred to as solid ink sticks, and to deliver the ink sticks 28 to a melting assembly 30 that melts the solid ink sticks 28 to a liquid ink suitable for forming images on print media. The ink loader 18 includes feed channels 34 into which the ink sticks 28 are inserted. Although a single feed channel 34 is visible in FIG. 1, the ink loader 18 includes a separate feed channel 34 for each color or shade of ink stick 28 used in the device 10. Ink sticks 28 are inserted into the feed channels 34 through insertion openings 38. Once inserted into a feed channel 34, the ink sticks 28 are urged toward the melting assembly 30 by an ink stick feed mechanism. Any suitable feed mechanism may be utilized. In the embodiment of FIG. 1, the feed mechanism includes a spring-loaded push block 40 configured to apply an urging force for moving ink sticks 28 toward the melting assembly 30. An ink stick 28 that arrives at the melting assembly 30 is heated to a phase change ink melting temperature to melt the ink stick to a molten liquid ink. Any suitable melting temperature may be used depending on a number of factors, such as the phase change ink formulation. The ink loader may be of a different configuration and may use ink in alternative solid forms, powdered or pelletized ink, for example.

The melted ink is received in a melt reservoir 44 and then supplied to at least one printhead 48. The printhead 48 includes inkjets configured to eject drops of melted ink. The printer 10 is an offset printer. Accordingly, the printhead 48 is positioned to direct the ink onto an image bearing surface 50 of a rotating imaging member 54. The imaging member 54 comprises a rotating drum, endless belt, band, or similar type of structure. A layer or film of release agent may be applied to the image bearing surface 50 by a release agent application assembly 58 to facilitate the transfer of ink images from the surface 50 to print media 60. In alternative embodiments, the printhead 48 may be positioned to direct the ink directly onto print media.

A media supply and handling apparatus 24 transports print media along a media path 64 defined in the printer 10 that guides print media 60 toward the image bearing surface 50 in synchronization with ink deposited onto the surface 50 by the inkjet printing mechanism 48. The media supply and handling apparatus 24 has at least one media source 68, such as a supply tray, for storing and supplying print media, such as paper, transparencies, or the like. The media supply and handling apparatus includes rollers, baffles, deflectors, and the like for transporting media along the media path 64.

Media conditioning devices may be positioned along the media path 64 for controlling and regulating the temperature of the print media so that the media arrives at the transfix apparatus 100 at a suitable temperature to receive the ink from the image bearing surface 50. For example, in the embodiment of FIG. 3, a preheating assembly 70 may be provided along the media path 64 for heating print media to an initial predetermined temperature prior to reaching the transfix apparatus 100. The preheating assembly 70 may rely on contact, radiant, conductive, or convective heat, or any combination, to bring the media to a target preheat temperature. As noted above, the use of the high-frequency transfix apparatus 100 may reduce or eliminate media preheating requirements. Accordingly, in some embodiments, media conditioning devices, such as the preheating assembly 70, may be omitted from the imaging printer 10.

Operation and control of the various apparatus, components and functions of the printer 10 are performed with the aid of a control apparatus 74. The control apparatus 74 includes a controller 78, electronic storage or memory 80, and a user interface (UI) 84. The controller 78 may comprise a processing device, such as a central processing unit (CPU), an application specific integrated circuit (ASIC), a field programmable gate array (FPGA) device, or microcontroller, configured to execute instructions stored in the memory 80. Multiple processors may be used. Any suitable type of memory or electronic storage may be used. For example, the memory 80 may be a non-volatile memory, such as read only memory (ROM), or a programmable non-volatile memory, such as EEPROM or flash memory. During operation, the controller 78 actuates the inkjet printing apparatus 48 to eject drops of ink onto the image bearing surface 50 to form images. The media supply and handling apparatus 24 in turn is activated to transport a sheet of print media 60 along the media path 64 toward the image bearing surface 50. The controller 78 is also connected to link 90.

In the embodiment of FIG. 1, a transfix apparatus 100 is shown positioned near the location where the media path 64 and the image bearing surface 50 converge to define a transfer or transfix zone 104 with respect to the media path 64 and image bearing surface 50 where at least a portion of the transfix process is performed. In alternative embodiments, the transfix apparatus 100 may be positioned at other locations with respect to the media path 64 to facilitate transfer and/or fixing of ink to print media depending on the configuration of the printer.

Figure 2A:
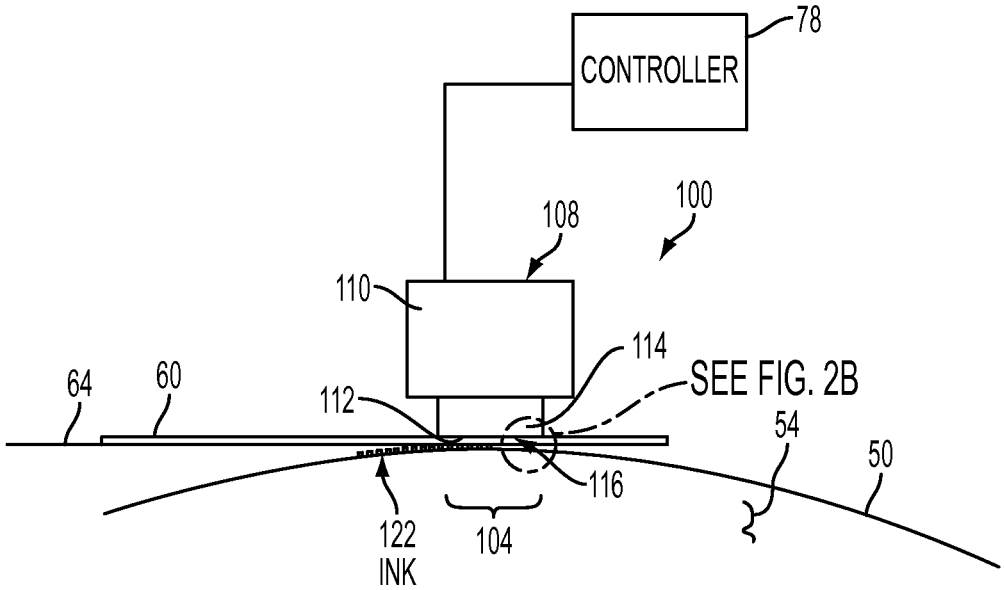
FIG. 2A is a schematic view of one embodiment of the transfix apparatus of the imaging device of FIG. 1 having one motion generator unit shown in position proximate an image bearing surface of the imaging device.
Figure 2B:
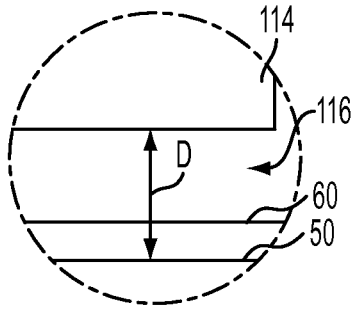
FIG. 2B shows the gap between the motion generator unit and the image bearing surface of FIG. 2A in greater detail.
Figure 3:
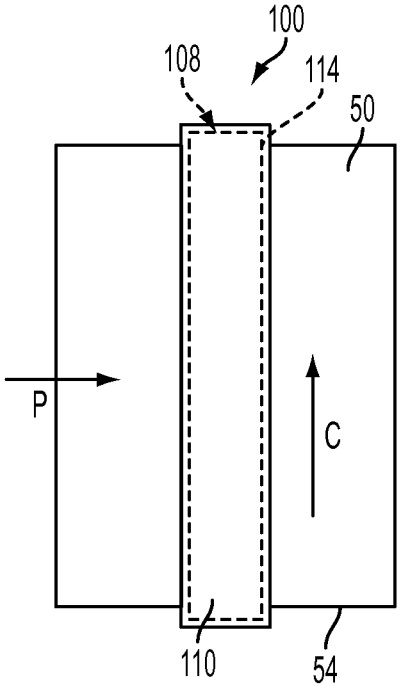
FIG. 3 is a plan view of the motion generator unit of the transfix apparatus of FIG. 2A shown extended across the width of the image receiving surface.

Referring to FIGS. 2A and 3, one embodiment of an image transfix apparatus 100 is shown in greater detail. As depicted, the image transfix apparatus 100 includes a motion generator unit 108 comprising a housing 110 and an ultrasonic mechanism 114. As depicted in FIG. 3, the housing 110 and ultrasonic mechanism 114 are sized to extend across the width of the image bearing surface 50 in a direction C that is generally perpendicular to the direction P of movement of the image receiving surface 50 in relation to the transfix apparatus 100. The front surface 112 defines a gap 116 between the image bearing surface 50 and the motion generator unit 108 through which the media path 64 extends. The housing 110 supports the ultrasonic mechanism 114 proximate the image bearing surface 50 with a front surface 112 of the ultrasonic mechanism 114 arranged a distance D from the surface 50 (FIG. 2B). The distance D may vary during image transfix processing. For example, the distance D is selected to be in a range equivalent to or greater than the height of an ink droplet on the image bearing surface and may include consideration for stacking overlap of pixels in the case of secondary and tertiary colors, depending on the color dithering technique to enable entry of the ink image and the leading edge of the media into the transfix zone 104. As the ink image on the image receiving surface and the print media are moving through the transfix zone 104, the distance D may be reduced to an appropriate distance to enable contact for image transfer. The distance D may also vary, based on variables, for example, motion generator configuration, the number of motion generators and the type of image, such as text or graphics printed with secondary colors. When moved into a transfer contact condition, the motion generator may be servo controlled, weighted or spring loaded to enable a nearly consistent image transfer contact for a range of media types and image content variations.

A plurality of ultrasonic transducers 118 is incorporated into the front surface 112 of the ultrasonic mechanism 114, as depicted in FIG. 3. Each ultrasonic transducer element 118 is configured to project from the front surface 112 at least enough to contact the image bearing surface 50 with sufficient pulse force to affect transfer, and then retract from the image bearing surface a sufficient distance to allow continued movement of the image bearing surface, ink image, and/or print media through the transfix zone 104. In one embodiment, the ultrasonic transducers 118 may be piezoelectric transducers. As is known in the art, piezoelectric transducers are configured to change shape in response to the application of an electric signal. An electrode (not shown) is attached to each transducer for applying an appropriate actuating energy to the transducer based on control signals from controller 78. The controller 78 is configured to actuate the ultrasonic transducers 118 as the ink image 122 and print media 60 move through the transfix zone 104.

Multiple pulse force impacts may be required across each pixel to facilitate the image transfix process, although in some applications a single impact may be sufficient. The rate and frequency of movement of the ultrasonic transducers 118 with respect to the image bearing surface is controlled to achieve a desired number of impacts across each pixel of the ink image as the image bearing surface and print media are moving through the transfix zone 104 at product throughput speeds. In one embodiment, the ultrasonic transducers are actuated at an operating frequency in the ultrasonic range between approximately 15 kHz and 200 kHz. Operating frequencies in the ultrasonic range enable multiple impacts to each pixel to be achieved. The ultrasonic motion also provides the added benefit of generating heat in the transfix zone 104 that facilitates the transfix process. The operating frequency generated by the motion generator units, however, may be any frequency that enables the ultrasonic transducers 118 to contact and withdraw from the moving print media and/or image receiving surface without substantially interfering with the transfix process or the throughput speed of the imaging apparatus, and that accomplishes sufficient image transfer or transfix to a receiving medium.

Figure 4:
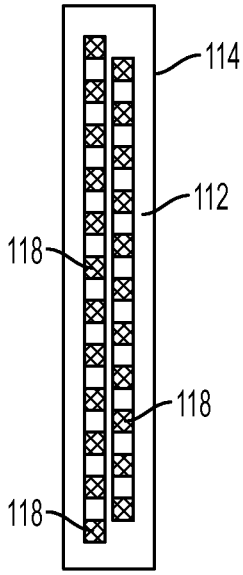
FIG. 4 is bottom elevational view of the motion generator of the transfix apparatus of FIG. 2A showing the ultrasonic elements.

In the embodiment of FIGS. 2A-4, the ultrasonic transducers 118 are arranged in the front surface 112 in one or more arrays that extend across the ultrasonic mechanism in the direction C. Each array is configured to provide substantially full coverage across the width of the image bearing surface 50 with each transducer 118 being configured to contact the image receiving surface across at least one ink droplet location, or pixel, in the transfix zone 104. FIG. 4 depicts one embodiment of an array of ultrasonic transducers 118 of the ultrasonic mechanism 114. As depicted, the ultrasonic transducers 118 of the array are arranged in two rows in an alternating pattern. The alternating pattern, which may be aligned with or without overlap, provides full width coverage of the image bearing surface 50.

Any number of ultrasonic transducers 118 and arrays of transducers 118 may be used in order to impart a suitable number of impacts to each ink droplet (through the print media) on the image bearing surface. For example, multiple arrays may be incorporated into a single motion generator unit 108. Alternatively, multiple motion generator units 108 may be utilized with each unit having one or more arrays of ultrasonic transducers. The front surface 112 of the ultrasonic mechanism 114 of a unit 108 may be shaped to conform the contour of the image bearing surface 50 in the transfix zone 104 so that multiple arrays of ultrasonic transducers 118 may each be positioned approximately the same distance D from the surface 50. The conformable configuration may be a somewhat matching curvature or a series of flats or near flats set at incremental angles to approximate a drum curvature. The number of elements and arrays is based on attaining a full line of contact coverage over the width of the image area.

Figure 5:
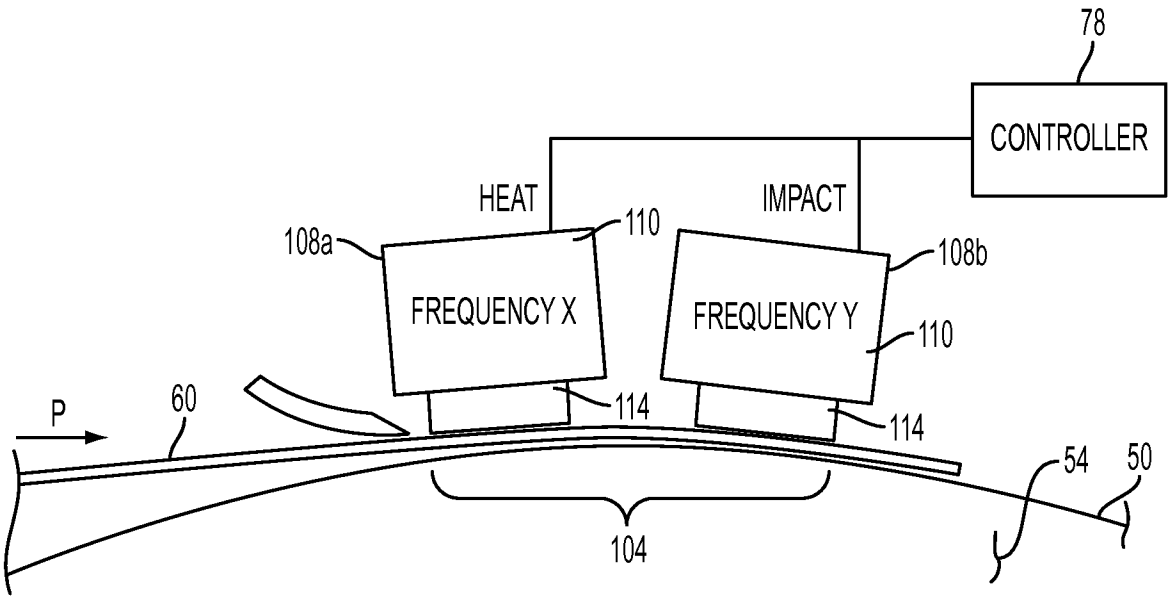
FIG. 5 is a schematic view of another embodiment of the transfix apparatus of the imaging device of FIG. 1 having two motion generator units arranged facing an image receiving surface in the form of a drum.
Figure 6:
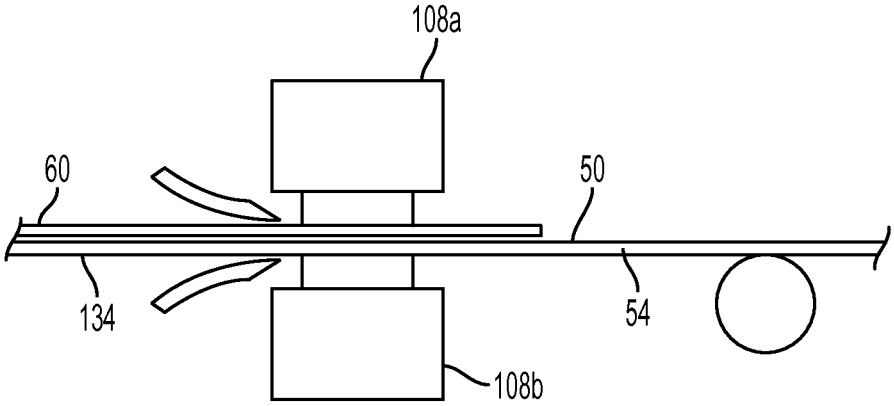
FIG. 6 is a schematic view of another embodiment of the transfix apparatus of the imaging device of FIG. 1 having two motion generator units arranged facing each other on opposite sides of an image receiving surface of an imaging member in the form of a moving band or belt.

In the embodiment of FIGS. 2A and 3, the transfix apparatus 100 comprises a single motion generator unit 108 having a plurality of ultrasonic transducers 118 that are cycled into contact with the image bearing surface 50 at substantially the same frequency. FIGS. 5 and 6 depict alternative embodiments of image transfix apparatus 100 in which two (or more) motion generator units 108*a* and 108*b* are utilized. Similar to the embodiment of FIGS. 2A and 3, each motion generator unit 108*a*, 108*b* includes a plurality of ultrasonic transducers (not visible in FIGS. 5 and 6) for imparting one or more impacts across each ink droplet in the transfix zone 104 at a predetermined frequency in the ultrasonic or near ultrasonic range. In the embodiments of FIGS. 5 and 6, however, each motion generator unit 108*a*, 108*b* may be configured to operate at a different frequency to affect image transfer.

In the embodiment of FIGS. 5, each motion generator unit 108*a*, 108*b* is arranged facing the image bearing surface 50 of the imaging member 54 with the first motion generator unit 108*a* being spaced apart from the second motion generator. The motion generator unit 108*a* is configured to impact the media in the transfix zone 104 at a first predetermined frequency, and the motion generator unit 108*b* is configured to impact the media in the transfix zone 104 at a second predetermined frequency that is different than the first predetermined frequency. Operating multiple motion generator units at different frequencies enables each to be operated at a frequency optimized to perform a particular part or portion of the transfix process. For example, in the embodiment of FIG. 5, the first motion generator unit 108*a* may be operated at one or more frequencies conducive to elevating the temperature of the media and ink to facilitate or partially transfer the image to the media. The second motion generator unit 108*b* may then be operated at a different frequency or range than the first unit 108*a* and may have greater motion range and impact influence to ensure the image is transferred to the media. Additional motion generator transfer units, in addition to units 108*a* and 108*b*, operating at any frequency or frequency range may be utilized to facilitate complete image transfer.

In the embodiment of FIG. 6, the motion generator units 108*a*, 108*b* are arranged on opposite sides of the image bearing surface 50. In this embodiment, the imaging member 54 comprises a thin belt or band having an outer surface 130 that serves as the image bearing surface 50 and an inner surface 134. Similar to the motion generator of FIGS. 2A and 3, the first motion generator unit 108*a* is arranged facing the outer surface 50. The second motion generator unit 108*b* is arranged facing the inner surface 134 at a location opposite from the first motion generator unit 108*a* and serves as a backing surface and may provide complementary impacts to those generated by the first motion generator unit 108*a*.

The first motion generator unit 108*a* is configured to impact the media in the transfix zone 104 at a first predetermined frequency, and the motion generator unit 108*b* is configured to impact the inner surface 134 of the imaging member 54 in matching phase or at a second predetermined frequency that may be the same as or different than the first predetermined frequency where impacts may or may not be phased. In the embodiment of FIG. 6, the ultrasonic action of the opposed motion generator units 108*a*, 108*b* facilitates a near frictionless passage of the imaging member 54, image bearing surface 50, and media between the motion generator units while the image is being transfixed to the print media in the transfix zone 104. Experimentation has shown that once an image has been transferred to media, further exposure to motion generator influence need not have negative effect on image quality. Image quality produced by transfixing an image on media by a motion generator positioned on the image side is application and process dependent.

The transfix apparatus described above should be distinguished from the vibratory devices used in toner printing systems. In those systems, vibrations at a resonant frequency are delivered only to the side of an image bearing surface that is opposite the image. The vibrations are intended to overcome electrostatic attraction of toner particles to the image bearing surface to facilitate the release of the toner particles to media. The transfix apparatus described above operates on the media to press the media into the ink on the image bearing surface. This action both provides localized heating of the media and helps spread the ink while facilitating the transfer of the ink to the media. The motion generators of the transfix apparatus when placed on the side of the image bearing surface opposite the image help heat the ink on the image bearing surface that may have cooled since being ejected from the printhead. Thus, the transfix apparatus described above operates differently on different components of the imaging process than the vibratory devices of toner imaging systems.

It will be appreciated that variations of the above-disclosed and other features, and functions, or alternatives thereof, may be desirably combined into many other different systems or applications. Various presently unforeseen or unanticipated alternatives, modifications, variations, or improvements therein may be subsequently made by those of ordinary skill in the art, which are also intended to be encompassed by the following claims.

What is claimed is:

1. A phase change ink imaging apparatus comprising:

a media transport configured to transport media along a path;

a moving member having an image bearing surface, the moving member being movable proximate at least a portion of the path;

at least one printhead configured to form an ink image on the image bearing surface;

at least one transducer separated from the path at a predetermined distance; and a controller operatively connected to the at least one transducer, the controller being configured to actuate the at least one transducer in response to the ink image being opposite the at least one transducer to extend a portion of the at least one transducer through the predetermined distance to contact media on the path and direct mechanical energy into the media on the path after the ink image has been formed on the image bearing surface to transfix the ink image onto the media.

2. The apparatus of claim 1 wherein the at least one transducer comprises a plurality of transducers, each transducer being operatively connected to the controller and the controller being configured to actuate each transducer in the plurality of transducers in response to the ink image being opposite the plurality of transducers to contact the media on the path and direct mechanical energy into the media and transfix the ink image onto the media.

3. The apparatus of claim 2 wherein the plurality of transducers are piezoelectric transducers.

4. The apparatus of claim 2, wherein each transducer in the plurality of transducers is configured to move a portion of each transducer into and out of contact with the media at approximately an ultrasonic frequency to direct mechanical energy into the media and transfix the ink image to the media.

5. The apparatus of claim 2 wherein the transducers are configured to operate at a first frequency to direct mechanical energy toward the path.

6. The apparatus of claim 5 wherein the first frequency is an ultrasonic frequency.

7. The apparatus of claim 2 wherein the moving member comprises a rotating drum and the image bearing surface comprises a surface of the drum, and the media is interposed between the image bearing surface of the drum and the plurality of transducers.

8. The apparatus of claim 2 wherein the image bearing surface comprises a first surface of the media moving along the path.

9. The apparatus of claim 8 wherein the plurality of transducers is arranged to direct mechanical energy into a second surface of the print media, the second surface being opposite the first surface upon which the ink image is formed.

10. The apparatus of claim 2 wherein the plurality of transducers comprise:

a first plurality of transducers configured to operate at a first frequency; and a second plurality of transducers configured to operate at a second frequency, the second frequency being different than the first frequency.

11. The apparatus of claim 10 wherein the first plurality of transducers and the second plurality of transducers are each arranged to direct mechanical energy toward a first side of the path.

12. The apparatus of claim 10 wherein the first plurality of transducers is arranged to direct mechanical energy toward a first side of the path and into a first side of the media, and the second plurality of transducers is arranged to direct mechanical energy toward a second side of the path and into a second side of the media, the second side being opposite the first.

13. A phase change ink imaging apparatus comprising:

a media transport configured to transport media along a path;

an image bearing surface configured to move proximate a portion of the path;

at least one printhead configured to form an ink image on the image bearing surface;

at least one motion generator positioned proximate the portion of the path and separated from the path by a predetermined distance, the at least one motion generator and the image bearing surface defining an image transfer zone through which the portion of the path extends, the at least one motion generator including piezoelectric transducers configured to impact print media moving along the portion of the path at one or more predetermined frequencies; and a controller operatively connected to the at least one motion generator, the controller being configured to actuate the piezoelectric transducers in the at least one motion generator in response to the ink image being opposite the at least one motion generator to extend a portion of at least one transducer in the at least one motion generator through the predetermined distance and direct mechanical energy toward the path and into the media transported along the portion of the path after the ink image has been formed on the image bearing surface to transfix the ink image onto the media.

14. The system of claim 13, at least one of the predetermined frequencies comprising a first ultrasonic frequency.

15. The apparatus of claim 14, the at least one motion generator comprising a first motion generator and a second motion generator, the first motion generator including piezoelectric transducers configured to impact print media at the first ultrasonic frequency, the second motion generator including piezoelectric transducers configured to impact print media at a second ultrasonic frequency, the second ultrasonic frequency being different than the first ultrasonic frequency.

16. The apparatus of claim 13, the at least one motion generator includes a first and a second motion generator arranged facing each other to define a transfer zone through which the image bearing surface and the portion of the path extend.

17. The apparatus of claim 16, wherein the image bearing surface comprises an outer surface of a moving belt, the belt including an inner surface opposite the image bearing surface.

18. The apparatus of claim 17 wherein the first motion generator includes piezoelectric transducers configured to impact print media moving proximate the image bearing surface of the belt, and the second motion generator includes piezoelectric transducers configured to impact the inner surface of the moving belt.

* * * * *